United States Patent [19]

Knoke et al.

[11] 4,440,264

[45] * Apr. 3, 1984

[54] LOCKING ASSEMBLY FOR A FOLDING SEAT

[75] Inventors: Silas J. Knoke, Seymour; James F. Stamper, Nashville, both of Ind.

[73] Assignee: Lear Siegler, Inc., Santa Monica, Calif.

[ * ] Notice: The portion of the term of this patent subsequent to Mar. 23, 1999 has been disclaimed.

[21] Appl. No.: 261,416

[22] Filed: May 7, 1981

Related U.S. Application Data

[63] Continuation of Ser. No. 73,578, Sep. 7, 1979, abandoned.

[51] Int. Cl.[3] ..... A47C 4/00; A47C 3/18; A47C 9/00

[52] U.S. Cl. ..... 182/126; 182/33; 297/59

[58] Field of Search ..... 182/124, 125, 126, 156, 182/159–161, 162, 33; 297/59, 60; 16/172

[56] References Cited

U.S. PATENT DOCUMENTS

| | | | |
|---|---|---|---|
| 472,603 | 4/1892 | Hamilton | 297/60 |
| 1,162,237 | 11/1915 | Hipolito | 16/172 |
| 1,369,246 | 2/1921 | Jones | 16/172 |
| 2,207,923 | 7/1940 | Kelso | 182/156 |
| 2,230,015 | 1/1941 | Rich | 182/161 |
| 2,948,332 | 8/1960 | Hamilton | 297/60 |
| 2,975,856 | 3/1961 | Anderson | 182/161 |
| 3,057,432 | 10/1962 | Harrison | 182/125 |
| 3,059,722 | 10/1962 | Rouse | 182/156 |
| 3,224,530 | 12/1965 | King | 182/33 |
| 3,227,243 | 1/1966 | Bates | 297/60 |
| 4,119,175 | 10/1978 | Herwynen | 182/125 |

FOREIGN PATENT DOCUMENTS

| | | | |
|---|---|---|---|
| 1103090 | 5/1955 | France | 182/125 |
| 666251 | 8/1964 | Italy | 182/125 |

*Primary Examiner*—R. P. Machado

*Attorney, Agent, or Firm*—Reising, Ethington, Barnard, Perry & Milton

[57] ABSTRACT

An improved locking assembly for a folding seat is disclosed. The assembly includes a support plate adapted to be fixedly mounted to a step at its lower surface. The seat is supported by a support member when the seat is in its support position. The assembly also includes a broad hook pivotally connected at one end thereof to the support plate at a position substantially midway between the sides of the seat to hold the support member in locking relationship with the step to prevent the step from unintentionally moving out of its support position.

4 Claims, 8 Drawing Figures

LOCKING ASSEMBLY FOR A FOLDING SEAT

This is a continuation, of application Ser. No. 73,578, filed Sept. 7, 1979, abandonned.

TECHNICAL FIELD

This invention relates to a locking assembly adapted for use with a foldable seat and in particular to locking assemblies adapted for use with a foldable seat and especially a foldable seat having at least one step supported on a support member in a supporting position, the locking assembly being adapted to lock the step to the support member in a supporting position of the foldable seat.

BACKGROUND ART

Prior patents disclose foldable seats including locking assemblies for locking the seats in a supporting position. Such locking assemblies are commonly incorporated on or comprise the inner connecting links which connect the step of the seat to the main frame of the seat. For example, the U.S. patent of Anderson et. al., U.S. Pat. No. 2,975,856; Harrison, U.S. Pat. No. 3,057,432 and King et. al., U.S. Pat. No. 3,224,530 generally show locking assemblies of the type to which this invention relates.

DISCLOSURE OF THE INVENTION

An object of the present invention is to provide an improved locking assembly especially adapted for use with the foldable seat having two back and two front support legs and having at least one step pivotally connected at its back portion to the back legs and supported on a support member at its front portion in a locking position wherein the assembly includes a support plate adapted to be fixedly mounted to the step at its lower surface thereof and a broad rigid hook pivotally connected at one end thereof to the support plate at a position substantially midway between the sides of the step to hold the support member in locking relationship with the step.

Another object of this invention is to provide a locking assembly especially adapted for use with a foldable seat having two back and two front legs and having at least one step pivotally connected at its back portion to the back legs and supported on a support member at its front portion, wherein the assembly includes a support plate adapted to be fixedly mounted to the step at its lower surface thereof and a broad rigid hook pivotally connected at one end thereof to the support plate and wherein the hook includes an inwardly curved portion curved away from the bottom surface of the support plate to lockingly engage the support member at its inner surface.

A further object of this invention is to provide a locking assembly especially adapted for use with a foldable seat having two back and two front support legs and having at least one step pivotally connected at its back portion to the back legs and supported on a support member at its front portion, wherein the assembly includes a support plate adapted to be fixedly mounted to the step at its lower surface thereof and a broad rigid hook pivotally connected to one end thereof to the support plate and wherein the hook includes an integrally connected stop member to limit the pivotal movement of the hook by engaging the support plate to allow the hook to engage the support member during downward pivotal movement of the step toward the support member.

In carrying out the above objects and other objects of this invention a preferred embodiment of the locking assembly which is adapted for use with a foldable seat having two back and two front support legs pivotally connected together and at least one step pivotally connected at its back portion to the back legs and also pivotally connected to a support member extending between its front legs, to alternately move downwardly and upwardly away from the support member, the step being supported on the support member at its front portion. The preferred embodiment includes a support plate adapted to be fixedly mounted to the step at its lower surface thereof, and a broad rigid hook pivotally connected at one end portion thereof to the support plate at a position substantially midway between the sides of the step to hold the support member in locking relationship with respect to the step in a locked position, thereby preventing the step from moving about the pivotal connection between the step and the back legs.

The objects, features and advantages of the present invention are readily apparent from the following detailed description of the best mode taken in connection with the accompanying drawings.

and

Figure 7A:
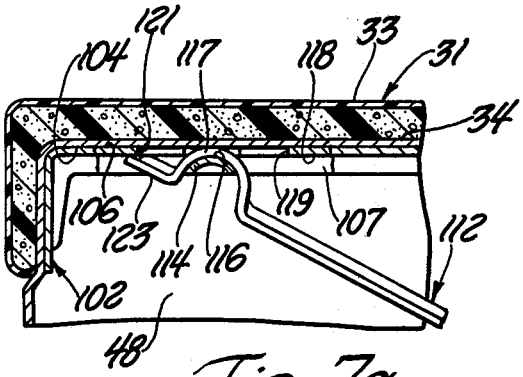
FIG. 7 is a sectional view of the apparatus taken along the line 7—7 of FIG. 6 partially broken away and slightly enlarged for illustrative purposes.
Figure 7:
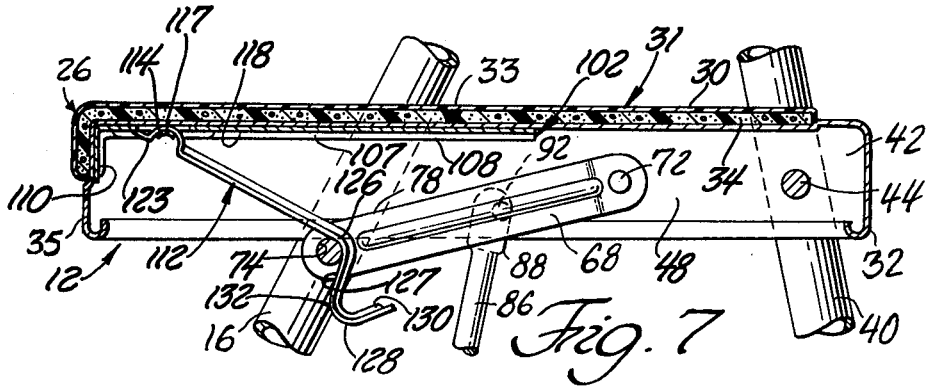

FIG. 7*a* is a sectional, enlarged view of a portion of FIG. 7.

BEST MODE FOR CARRYING OUT THE INVENTION

Referring now to the drawings there is shown an illustrative embodiment of the invention in a locking assembly especially adapted for use with a foldable seat of a combined chair and stool apparatus.

Figure 1:
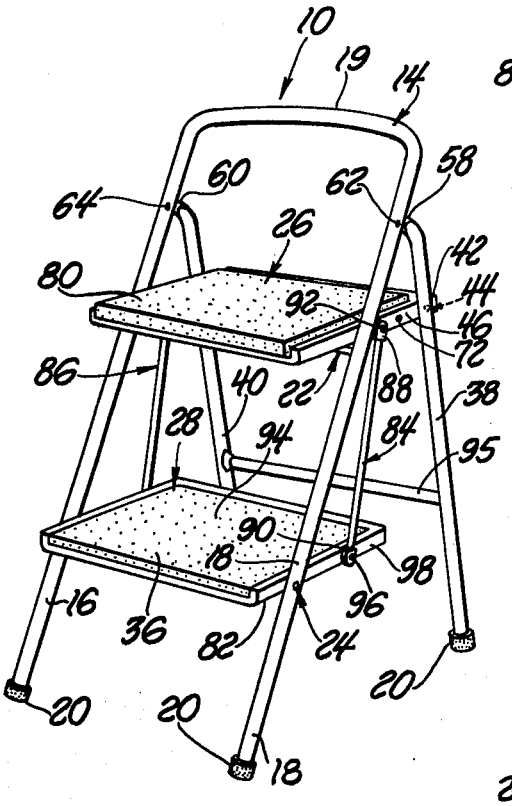
FIG. 1 is a perspective view which shows a combined chair and stool apparatus in a supporting position.
Figure 2:
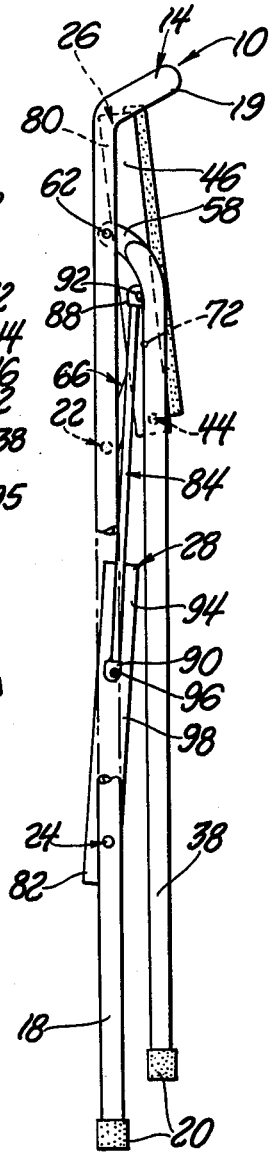
FIG. 2 is a side elevational view of the apparatus of FIG. 1 in its extreme most folded position.
Figure 3:
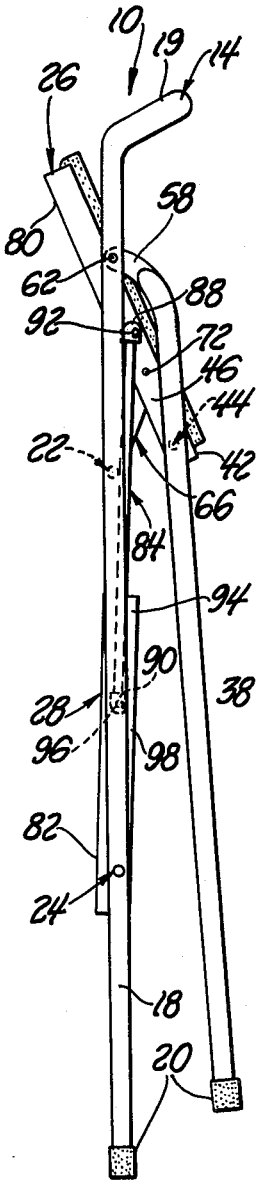
FIG. 3 is a side elevational view of the apparatus of FIG. 1 in a locked folded position.
Figure 4:
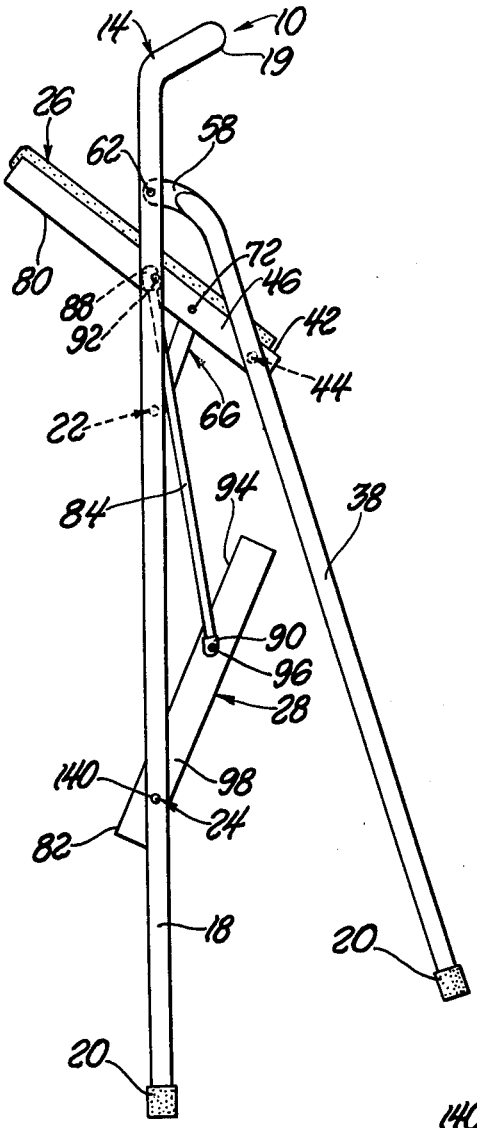
FIG. 4 is a side elevational view of the apparatus of FIG. 1 in an unlocked partially folded position.
Figure 5:
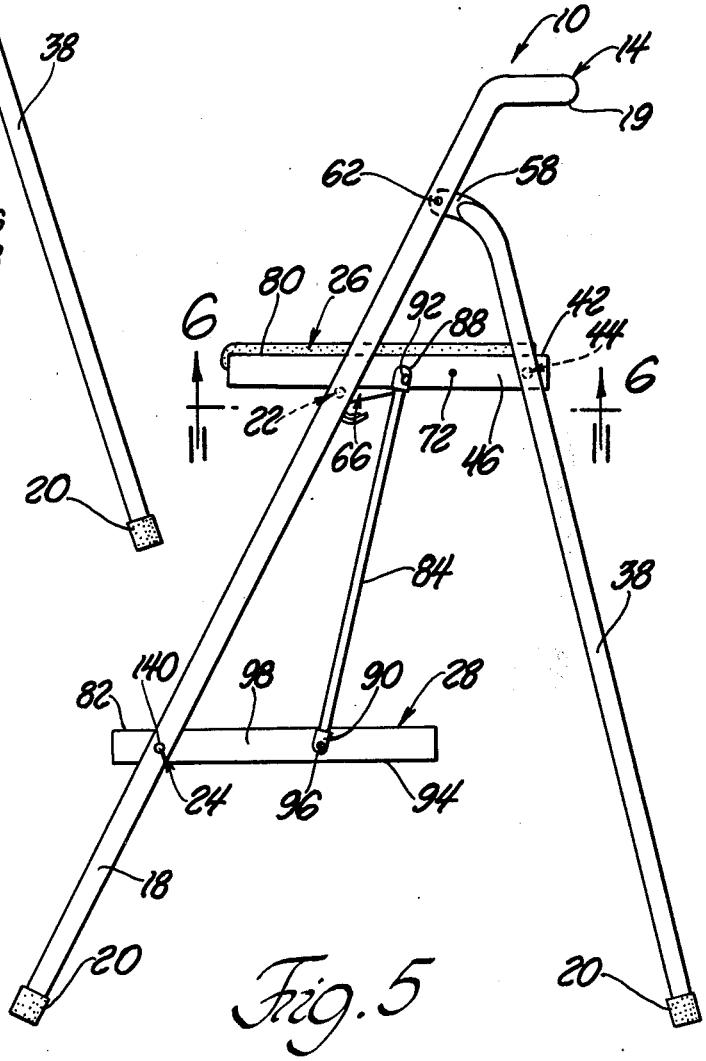
FIG. 5 is a side elevational view of the apparatus of FIG. 1 in the supporting position.

Referring to FIG. 1, the chair and stool apparatus is generally indicated at 10. The apparatus 10 has a range of folded positions as indicated in FIGS. 2, 3 and 4 and a supporting position as indicated in FIGS. 1 and 5. In FIGS. 2 and 3 the apparatus 10 is shown in locked folded positions while in FIG. 4 the apparatus 10 is shown in an unlocked partially folded position. The apparatus 10 is locked in both of the supporting positions in FIGS. 1 and 5 by a locking assembly generally indicated at 12 in FIGS. 6 and 7.

With reference to FIG. 1, the apparatus 10 includes a U-shaped member generally indicated at 14 having a pair of metal legs comprising the front legs 16 and 18 of the apparatus 10. The U-shaped member 14 comprises a hollow drawn steel tube having a baked enamel or chrome finish. Conventional rubber protector tips 20 are disposed on the ends of the front legs 16 and 18.

The apparatus 10 includes a pair of hollow, metal rod-shaped support members. The support members are spaced apart and comprise an upper support member generally indicated at 22 in FIGS. 1 and 6 and a substantially identical lower support member 24. Both of the support members 22 and 24 extend between the front legs 16 and 18 and are fastened thereto, for example, by screws, rivets or other fasteners.

Figure 6:
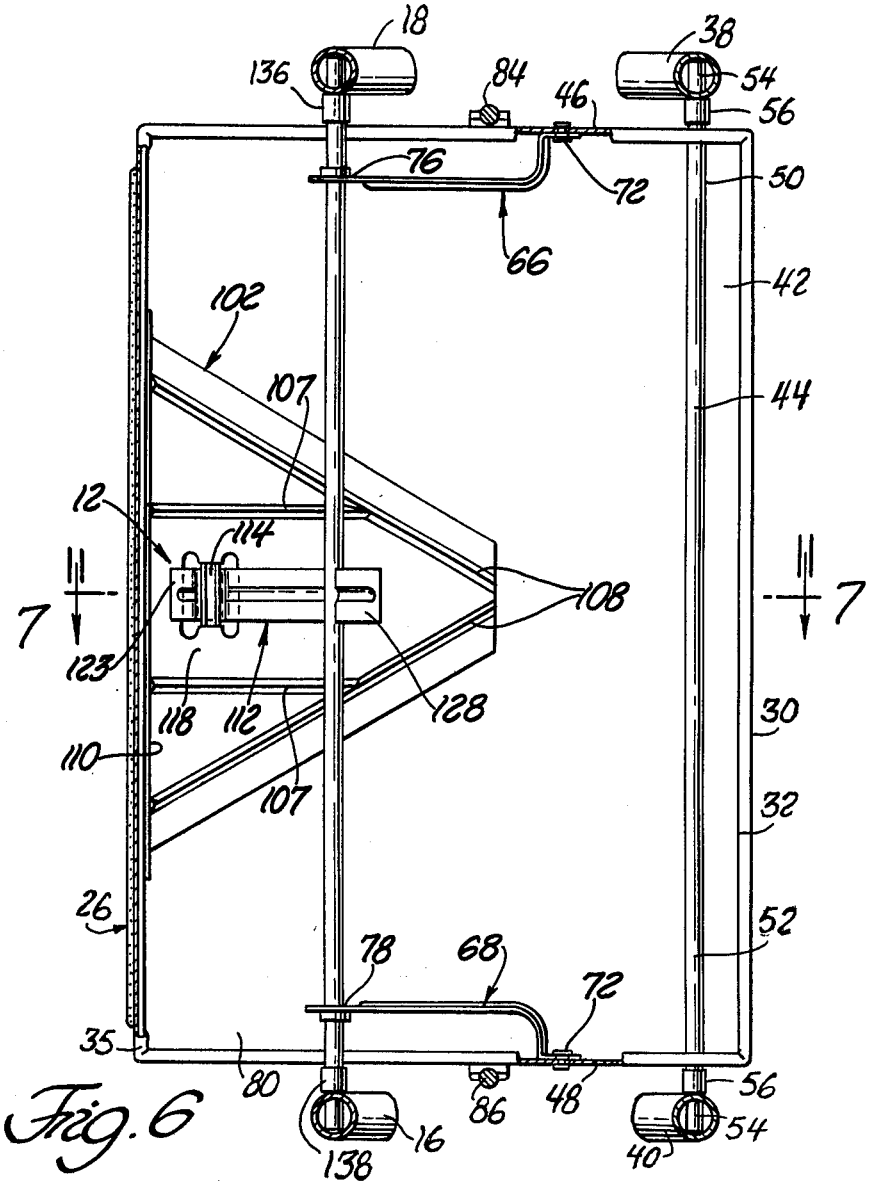
FIG. 6 is a sectional view of the apparatus taken along the line 6—6 of FIG. 5 partially broken away and slightly enlarged for illustrative purposes.

The apparatus 10 further includes a pair of spaced upper and lower planar steps generally indicated at 26 and 28, respectively. As shown in FIGS. 6 and 7, the upper step 26 comprises a substantially rectangular frame member generally indicated at 30 having an open bottom defined by an inwardly curved edge portion 32. The side and top surfaces of the frame member 30 are indented or depressed to accommodate a cushion or padding generally indicated at 31 having a vinyl covering 33. The padding 31 is positioned and held in a conventional fashion in a depression 34 such as with an adhesive.

The lower step 28 includes a vinyl covered steel plate 36 (FIG. 1) fixedly disposed in an indented or depressed portion of the lower step 28 similar to the depression 34 in the upper step 26.

The apparatus 10 also includes a pair of spaced, hollow metal back legs 38 and 40 which are pivotally connected to the top step 26 adjacent the back edge 42 of the top step 26 by a rigid bar generally indicated at 44 which extends the entire width of the top step 26 through side walls 46 and 48 of the top step 26 as shown in FIG. 6.

The back legs 38 and 40 are pivotally connected as shown in FIG. 6 to the bar 44 at its ends 50 and 52 which extend through the hollow back legs 38 and 40 by stud and collar members 54 and 56, respectively, on the bar 44 in a conventional fashion. The collar members 56 space the back legs 38 and 40 from the side walls 46 and 48 of the upper step 26 while the studs 54 allow the pivotal movement of the back legs 38 and 40 on and about the longitudinal axis of the bar 44 at its ends 50 and 52.

The back legs 38 and 40 are also pivotally connected to the front legs 18 and 16 respectively above the pivotal connection between the upper step 26 and the back legs 38 and 40 in the supporting position as shown in FIG. 1. As is best shown in FIG. 1, the back legs 38 and 40 include flanged end portions 58 and 60, respectively, for making the desired pivotal connection to the front legs 18 and 16 respectively. The hollow legs 18 and 16 are slotted to received the flanged end portions 58 and 60 therein. The flanged portions 58 and 60 are pivotally connected within the slots of the front legs 18 and 16, respectively, by rivets 62 and 64 which extend through their corresponding end portions 58 and 60 and legs 16 and 18.

As best shown in FIGS. 6 and 7, the apparatus 10 also includes a pair of spaced, rigid, reinforced metal pivot links generally indicated at 66 and 68 which are pivotally connected to the side walls 46 and 48, respectively, at the back portion 70 of the upper step 26 by rivets 72 which extend through the end portions of the pivot links 66 and 68 and the side walls 46 and 48, respectively, of the upper step 26. The pivot links 66 and 68 are also pivotally connected to the upper support member 22 which extends through apertures 74 formed through the opposite end portions 76 and 78 of the pivot links 66 and 68, respectively. The pivot links 66 and 68 extend rearwardly from the upper support member 22. In the supporting position shown in FIG. 6 the upper support member 22 supports the upper step 26 at the front portion 80 of the upper step 26.

The lower step 28 is pivotally attached at its front portion 82 to the front legs 16 and 18 about the lower support member 24 in a conventional fashion.

The apparatus 10 also includes a second pair of spaced, rigid pivot links 84 and 86 which comprise hollow drawn-steel tubes having opposite ends terminating in upper and lower flange portions 88 and 90, respectively. The second pair of pivot links 84 and 86 are pivotally connected at their upper flange portions 88 to the side walls 46 and 48, respectively, of the upper step 26 such as by rivets 92 which extend through off-centered holes formed through the flange portions 88 and 90. The rivets 92 further extend through the side walls 46 and 48 to pivotally secure the second pair of pivot links 84 and 86 to the top step 26.

The second pair of pivot links 84 and 86 are also pivotally connected at their lower flange portions 90 to the back portion 94 of the lower step 28 by rivets 96 (only one of which is shown) and which extend through the off-centered holes formed through the flange portions 90 and the side walls 98 of the lower step 28 in the same fashion as upper flange portions 88 of the links 84 and 86 attached to the side walls 46 and 48 of the upper step 26.

The back legs 38 and 40 have attached to their bottom ends the leg protector tips 20 in the same fashion as the leg protector tips 20 are attached at the bottom ends of the front legs 16 and 18.

A horizontal support bar or brace 95 extends between the back legs 38 and 40 and is fixedly connected thereto at its opposite ends to the back legs 38 and 40 such as by welding to thereby provide structural strength between the back legs 38 and 40.

As is best shown in FIGS. 6 and 7, locking means or the locking assembly 12 is provided for locking the apparatus 10 in the supporting position and thereby prevents pivotal movement of the U-shaped member 14 and the upper step 26 with respect to the back legs 38 and 40.

The locking assembly 12 includes a trapezoidal, ribbed, metal support plate generally indicated at 102 fixedly mounted at the lower surface 104 of the top step 26 at its top surface 106 such as by welding. The plate 102 includes a pair of parallel, stamped, reinforcing, U-shaped ribs 107 and a pair of angled, stamped, reinforcing, V-shaped ribs 108. The plate 102 also includes an integral forward flange portion 110 which extends downwardly from the lower surface 104 of the upper step 26 and is immediately adjacent the inner surface of the front portion 35 of the upper step 26.

The locking assembly 12 also includes a broad, rigid, ribbed, metal hook generally indicated at 112 which is pivotally connected at its end portion to the support plate 102 by a curved, integrally formed flange 114 downwardly depending from the bottom surface 118 of the support plate 102. The flange 114 has a curved upper surface 116 (FIG. 7*a*) in which a complementary curved portion 117 of the hook 112 slidably mates to provide the pivotal connection therebetween. The curved portion 117 extends between a pair of apertures 119 and 121 separated by the flange 114 and terminates in an integrally formed stop member 123 which will be described in greater detail hereinafter.

As shown in FIG. 7, the hook 112 includes an integral, inwardly curved portion 126 curved away from the bottom surface 118 of the support plate 102 for engaging the upper support member 22 about its curved inner surface. The hook 112 also includes an integral second end portion 128 opposite the first pivotally connected end portion of the hook 112. The second end portion 128 is curved outwardly towards the bottom surface 118 of the support plate 112 and has an inner concave surface 130 and an outer convex surface 132, the outer convex surface 132 extending below the upper support member 22 in the locked supporting position.

The stop member 123 limits the pivotal movement of the hook 112 about the flange 114 by engaging the lower surface 118 of the support plate 102 at its extrememost downward position to thereby allow the hook 112 to engage the upper support member 22 during the downward pivotal movement of the upper step 26 towards the upper support member 22. In other words, as the upper step 26 moves downwardly the curve portion 126 of the hook 112 engages the upper support member 22 and thereafter the hook 112 may lockingly engage the upper support member 22 by sliding along the inner curved surface 127 of the inwardly curved portion 126 until it moves into its locking position.

The apparatus 10 is moved out of its supporting position as shown in FIG. 5 and into one of its folded positions as shown in FIG. 4 by first unlatching the hook 112 from the upper support member 22 by applying a force against the outer convex surface 132 of the end portion 128 until the hook 112 disengages the support member 22. Thereafter, as the apparatus 10 is folded from the supporting position through a range of folded positions including a position as shown in FIG. 4, the front legs 16 and 18 pivotally move toward the back legs 38 and 40. The front portion 80 of the upper step 26 pivots upwardly about the bar 44 as do the rivets 72. The back portion 94 of the lower step 28 rotates upwardly about the lower support member 24 as the second pair of pivot links 84 and 86 pull the lower step 28 upwardly until the apparatus 10 is in its foldedmost position as shown in FIG. 2. When the apparatus is in the position as shown in FIG. 2, the second pair of links 84 and 86 are in a slightly angled, overcenter position with respect to the plane of the lower step 28. In other words, the center of the rivet 96 is slightly forward a straight line (not shown) drawn between the pivotal connection 24 (between the lower step 28 and the front leg 18 center of the rivet 92) so as to hold the apparatus 10 in a locked, folded position.

An attempt to pivotally move the apparatus 10 out of the position shown in FIG. 2 towards the position shown in FIG. 4 causes the second pair of pivot links 84 and 86 to engage the upper support member 22 as shown in FIG. 3. The pivot links 84 and 86 engage the member 32 between the front legs 16 and 18 and the upper step 26 at collar members 136 and 138 of the upper support member 22, which are best seen in FIG. 6. As a result, the folded positions as shown in FIGS. 2 and 3 define the extrememost positions of a range of locked, folded positions in which the apparatus 10 is locked in a folded position.

To allow the apparatus 10 to move out of its folded, locked position, it is necessary to apply a force at the back portion 94 of the lower step 28 to disengage the second pair of pivot links 84 and 86 from the collars 136 and 138 and at the same time move the lower step 28 out of its overcenter position. In this way the apparatus 10 can move to its unlocked, folded position as shown in FIG. 4 and subsequently back into its supporting position as shown in FIGS. 1, 5, 6 and 7.

While the preferred embodiment of the combined chair and stool apparatus including a locking assembly has been shown and described herein in detail, those skilled in this art will recognize various alternative designs as defined by the following claims.

What is claimed is:

1. A locking assembly in combination with a foldable seat movable between a folded position and a supporting position, the seat including a support member extending between two of said legs and also including a step having a portion that is moved toward and away from the support member during movement of the seat between the folded and supporting positions, and said portion of the step being supported on the support member in the supporting position, the assembly comprising:

a support plate fixedly mounted to the lower side of the step at said portion thereof, said support plate including a pair of spaced apertures and an integral flange downwardly depending from the support plate between the pair of apertures, and a broad rigid hook having one end portion extending through said apertures and over said flange to pivotally connect the hook to the step, said hook having a second end portion for engaging the support member in a locked position of the hook to selectively secure the step to the support member and thereby prevent movement of the step with respect to the legs, said hook having a stop on the one end portion thereof for engaging the support plate to position the second end portion thereof for engagement with the support member upon movement toward the support member, said end portions of the hook each having a ribbed construction, and said hook being movable to disengage the support member to thereby permit movement of the seat to the folded position.

2. The assembly as claimed in claim 1 wherein said flange has a curved portion and wherein said one end portion of said hook includes a complementary curved portion pivotally supported by the curved portion of the flange.

3. The assembly as claimed in claim 1 wherein said hook includes an inwardly bent portion bent away from the bottom surface of said support plate to lockingly engage the support member at the inner surface of the bent portion.

4. The assembly as claimed in claim 3 wherein the second end portion of the hook is curved outwardly and defines an inner concave surface and an outer convex surface, said outer convex surface extending below the support member in said locked position.

* * * * *